United States Patent [19]

Mandai

[11] Patent Number: 4,766,409

[45] Date of Patent: Aug. 23, 1988

[54] THERMISTOR HAVING A POSITIVE TEMPERATURE COEFFICIENT OF RESISTANCE

[75] Inventor: Haruhumi Mandai, Nagaokakyo, Japan

[73] Assignee: Murata Manufacturing Co., Ltd., Japan

[21] Appl. No.: 801,679

[22] Filed: Nov. 25, 1985

[51] Int. Cl.[4] ..... H01C 7/10

[52] U.S. Cl. ..... 338/22 R; 338/25; 29/612

[58] Field of Search ..... 338/22 R, 22 SD, 25, 338/254, 21; 29/612, 610 R; 219/494, 505; 501/134, 137; 252/520, 62.3 BT; 264/61

[56] References Cited

U.S. PATENT DOCUMENTS 3,965,552 6/1976 Rutt ..... 29/625 X
4,189,760 2/1980 Marshall ..... 264/61 X
4,290,041 9/1981 Utsumi et al. ..... 338/21
4,330,703 5/1982 Horsma et al. ..... 338/22 R

*Primary Examiner*—E. A. Goldberg
*Assistant Examiner*—M. M. Lateef
*Attorney, Agent, or Firm*—Ostrolenk, Faber, Gerb & Soffen

[57] ABSTRACT

A thermistor which includes a ceramic sintered body formed of a plurality of inner electrodes alternating with a corresponding plurality of ceramic layers, outer electrodes being connected to specific ones of the inner electrodes. Each ceramic layer a positive temperature coefficient of resistance. The inner electrode layers are obtained by injecting molten base metal having a low melting point such as lead, tin or lead-tin alloy into gap layers previously defined in the sintered body between the laminated ceramic layers from the outside under pressure and hardening the same.

27 Claims, 3 Drawing Sheets

THERMISTOR HAVING A POSITIVE TEMPERATURE COEFFICIENT OF RESISTANCE

BACKGROUND OF THE INVENTION

The present invention relates to a thermistor having a positive temperature coefficient of resistance, and more particularly, it relates to a laminated type thermistor having a positive temperature coefficient of resistance.

An example of a prior art thermistor (hereinafter referred to as "PTC thermistor") having a positive temperature coefficient of resistance is formed of semiconductor ceramic material composed mainly of barium titanate and a small amount of a rare earth element such as niobium (Nb), antimony (Sb), tantalum (Ta), tungsten (W), yttrrium (Y) or another rare earth element. Manganese (Mn) is added as a characteristic improving agent for increasing the positive temperature coefficient of resistance, along with silicon dioxide ($SiO_2$) and/or aluminum oxide ($Al_2O_3$) serving as mineralizer.

Such a semiconductor ceramic device is generally formed with electrodes having ohmic properties. It is well known that such electrodes having ohmic properties may be formed of a metal such as indium-gallium alloy, nickel, or aluminum.

On the other hand, a practical PTC thermistor is required to be low in resistance. For example, it requires a low-resistance PTC thermistor having a resistance value of about 0.3 to 3Ω to protect the type of DC motor used in driving the power window of an automobile from overheating.

A circuit design for satisfying such requirement may include a plurality of PTC thermistors electrically connected in parallel with each other. However, such a prallel connection of PTC thermistors is not preferable since it substantially increases the size of the circuit.

Therefore, the present inventor has attempted to provide a laminated type of PTC thermistor by laminating ceramic layers together with a plurality of inner electrodes. Such a laminated type PTC thermistor comprises a monolithic ceramic sintered body which is obtained by firing a plurality of laminated ceramic layers and a pair of outer electrodes. The outer electrodes are formed on two different regions off the outer surface of the ceramic sintered body so as to connect each respective outer electrode to specific ones of the inner electrodes, whereby a plurality of resistors between respective pairs of inner electrodes are formed in parallel with each other.

The inventor attempted to employ a prior technique of manufacturing the aforementioned laminated type PTC thermistor, wherein the inner electrodes are formed of a metal having a high melting point such as gold (Au), platinum (Pt), palladium (Pd) or silver-palladium alloy, which is resistant to the high temperatures applied in a firing step included in the steps of manufacturing the PTC thermistor. More specifically, a paste containing such a metal having a high melting point may be coated by screen printing on ceramic green sheets, which in turn are laminated and then integrated by thermocompression bonding. The integrated body is then fired in an oxidizing atmosphere. However, such metals having high melting points cannot form ohmic electrodes, and accordingly are inappropriate for the inner electrodes of the laminated type PTC thermistor.

SUMMARY OF THE INVENTION

It is an object of the present invention to provide a laminated type PTC thermistor having low resistance.

According to an aspect of the present invention, a laminated type PTC thermistor has inner electrodes which are in ohmic contact with semiconductor ceramic material.

A PTC thermistor according to an embodiment of the present invention comprises a ceramic sintered body obtained by firing ceramic material having a positive temperature coefficient of resistance. The ceramic sintered body has within it a plurality of gap layers, each of which opens to the exterior of the body at one of two different regions on its outer surface. Base metal material having a low melting point is injected in its molten state and under pressure into the gap layers from the outside, and hardened to define a plurality of inner electrode layers. A pair of outer electrodes are provided in said two different regions on the outer surface of the ceramic sintered body, to be electrically connected to specific ones of the inner electrode layers.

In a preferred embodiment of the present invention, the base metal material having a low melting point comprises essentially lead, tin or lead-tin alloy.

The base metal material having a low melting point, e.g., lead, tin or lead-tin alloy, employed for preparing the inner electrodes in the present invention, has generally been thought unsuitable for forming electrodes on the outer surface of ceramic material, since it adheres to ceramics only with difficulty. In addition, the prior art has not confirmed whether lead, tin or lead-tin alloy presents ohmic properties on semiconductor ceramic material.

According to the present invention, however, the electrodes that are directly in contact with the semiconductor ceramic material are inner electrodes arranged within the ceramic sintered body, and hence no problem is caused by the inferior adhesion of the base metals to ceramics. Further, it has been learned that lead, tin or lead-tin alloy may form a very good ohmic contact with semiconductor ceramics.

Thus, in the laminated type PTC thermistor according to the present invention, the inner and outer electrodes effectively form a plurality of thermistor elements connected in parallel, whereby a PTC thermistor is readily obtained having a low resistance of, e.g., 0.3 to 3Ω.

DESCRIPTION OF THE PREFERRED EMBODIMENTS

Following is a description of a method for preparation of a ceramic sintered body having gap layers therein, for forming inner electrode layers by injection of base metal material.

Figure 1:
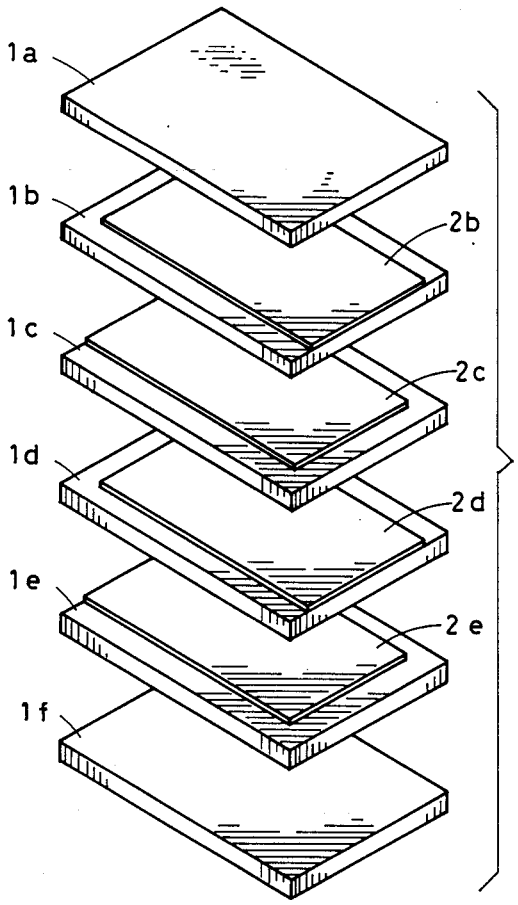
FIG. 1 is an exploded perspective view showing a preparation step of laminating ceramic green sheets.

As shown in FIG. 1, ceramic green sheets 1b to 1e have paste layers 2b to 2e containing ceramic powder and carbon applied thereto by screen printing. The paste layers 2b to 2e are formed with one end portion of each layer 2b–2e extending to a respective one of the outer surfaces of the body defined by the end surfaces of the ceramic green sheets 1b to 1e. The ceramic powder contained in the paste layers 2b to 2e is preferably identical in composition to the ceramic green sheets 1b to 1e, so that the paste layers 2b to 2e will be ceramicized by the same sintering reaction as the sheets 1b–1e and under the same conditions whereby the paste layers and ceramic green sheets are sintered and consolidated into a monolithic body by a single firing step.

With the ceramic green sheets 1b to 1e thus prepared, ceramic green sheets 1a and 1f, which are not provided with paste layers are sequentially laminated as shown in FIG. 1 such that the end portions of the paste layers 2b to 2e are exposed at respective edges of the ceramic green sheets 1b to 1e and the layers are then bonded by compression to each other.

The ceramic green sheets 1a to 1f are composed essentially of material that shows a positive temperature coefficient of resistance after sintering. For example, the material therefor may contain barium titanate ($BaTiO_3$), with yttrium oxide ($Y_2O_3$) serving as a semiconductoring agent (dopant), manganese dioxide ($MnO_2$) serving as a characteristic improving agent for increasing the positive temperature coefficient of resistance, and silicon dioxide ($SiO_2$) serving as a mineralizer.

Then the laminated body is fired in air at about of 1300° C. for about one to two hours.

Figure 2:
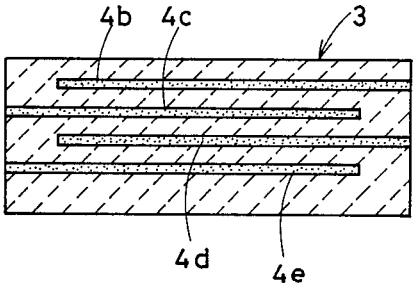
FIG. 2 is a sectional view showing a ceramic sintered body after firing of the laminated ceramic green sheets.

FIG. 2 shows a ceramic sintered body 3 obtained through the aforementioned firing step. In such a ceramic sintered body 3, the carbon contained in the paste layers 2b to 2e is scattered by the heat of the firing process; that is, oxidized and removed in the form of $CO_2$, leaving behind interconnected voids in the paste layers, so that the remaining ceramic powder defines porous gap layers 4b to 4e. As seen in FIG. 2, the gap layers 4b to 4e alternately extend to opposite end surfaces of the ceramic sintered body 3.

As hereinabove described with reference to FIG. 1, the paste layers 2b to 2e containing ceramic powder and carbon are printed on the ceramic green sheets 1b to 1e in order to define the gap layers 4b to 4e. Thus, the ceramic powder remains in the gap layers 4b to 4e through the firing step, thereby serving as supports for maintaining the configurations of the gap layers 4b to 4e. Such ceramic powder may be omitted from in the paste layers 2b to 2e if not necessary to prevent the surfaces adjacent to the gap layers 4b to 4e from sagging.

Figure 3:
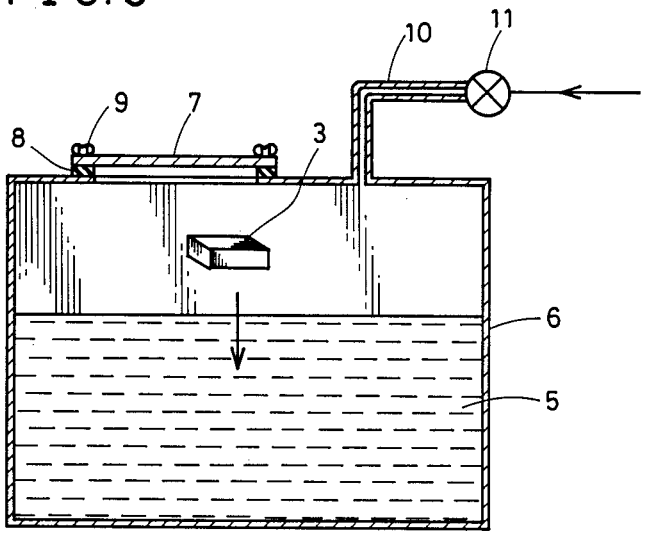
FIG. 3 illustrates a step of injecting base metal material in a molten state into a plurality of gap layers defined in the ceramic sintered body shown in FIG. 2.

Then, as shown in FIG. 3, the ceramic sintered body 3 is dipped in a vessel 6 containing molten base metal material 5 having a low melting point, such as lead, tin or lead-tin alloy. The vessel 6 has a lid 7 to enable access to the vessel 6 from the outside. The lid 7 is sealed by appropriate packing material 8, and held closed by appropriate fasteners 9. Introduced in the vessel 6 is a pipe 10, which is connected with an appropriate pressure source (not shown) through a valve 11.

The ceramic sintered body 3 is thus dipped into the molten base metal material 5, the liquid surface of the base metal material 5 being pressurized by a pressurizing gas introduced through the valve 11 and the pipe 10. Thus, the base metal material 5 is easily injected into the gap layers 4b to 4e (FIG. 2) defined in the ceramic sintered body 3.

Figure 4:
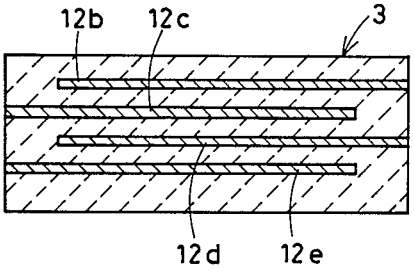
FIG. 4 is a sectional view showing the ceramic sintered body provided with inner electrodes in the step shown in FIG. 3.

Then, the ceramic sintered body 3 is taken out from the molten base metal material 5 and cooled to harden the base metal material in the gap layers 4b to 4e. After cooling, the ceramic sintered body 3 has inner electrodes 12b to 12e, as shown in FIG. 4. Then, the valve 11 is closed, the lid 7 is opened, and the ceramic sintered body 3 thus obtained is taken out of the vessel 6.

Figure 5:
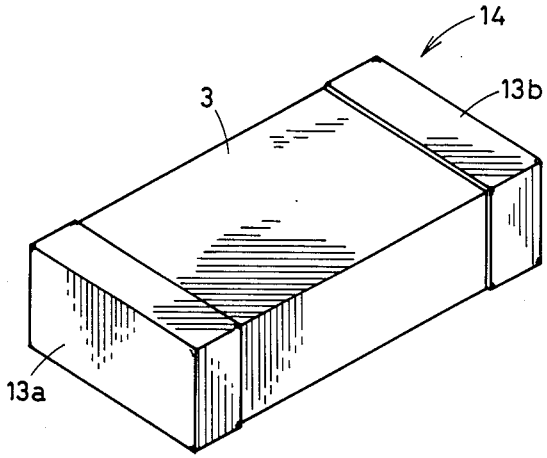
FIG. 5 is a perspective view showing a laminated type PTC thermistor obtained by forming a pair of outer electrodes on the ceramic sintered body shown in FIG. 4.

Then, as shown in FIG. 5, the ceramic sintered body 3 is provided with a pair of outer electrodes 13a and 13b on its opposite end portions to be electrically connected with specific ones of the inner electrodes 12b to 12e. Thus, a laminated type PTC thermistor 14 is obtained. The outer electrodes 13a and 13b typically comprise nickel films formed by electroless plating.

Figure 6:
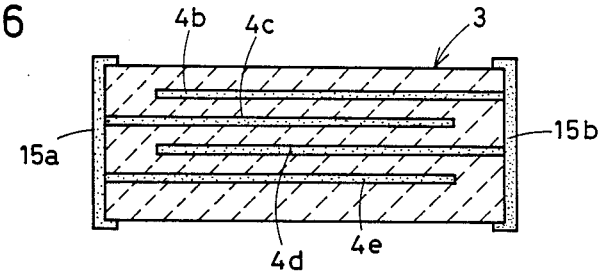
FIG. 6 is a sectional view illustrating another embodiment of the present invention, which shows a ceramic sintered body having porous barrier layers, prior to injection of base metal material to define inner electrodes.

FIG. 6 shows another aspect of the invention. In order to form the inner electrodes 12b to 12e jointly with the outer electrodes 13a and 13b, porous barrier layers 15a and 15b are preferably formed on the end surfaces of the ceramic sintered body 3 prior to the injection of the base metal material 5 which comprises the inner electrodes 12b to 12e. Such barrier layers 15a and 15b prevent leakage of the base metal material 5 from the gap layers 4b to 4e when the ceramic sintered body 3 is taken out of the molten base metal material 5 as shown in FIG. 3. The porous barrier layers 15a and 15b do not prevent the injection of the base metal material 5 into the gap layers 4b to 4e under pressure.

The porous barrier layers 15a and 15b may be formed by any material such as ceramics and metal. Preferably the barrier layers 15a and 15b are formed by coating a paste of trinickel boride ($Ni_3B$) and lead borosilicate glass frit on the end surfaces of the sintered ceramic body 3 before they are baked in a natural atmosphere. Such metal containing barrier layers 15a and 15b would also serve as outer electrodes since they are not dissolved by dipping in the bath of the molten base metal material 5.

The porous barrier layers 15a and 15b may also be formed of ceramics, the base metal material 5 penetrating therethrough into the gap layers 4b to 4e when the ceramic sintered body 3 is dipped in the bath of base metal material 5. The base metal remains in the porous barrier layers 15a and 15b themselves when the ceramic sintered body 3 is taken out of the bath of base metal. Therefore, since the porous barrier layers 15a and 15b contain substantial quantities of the base metal, the barrier layers also serve as outer electrodes.

Such outer electrodes can be subjected to soldering. Alternatively, additional outer electrodes may be provided on the aforementioned two types of barrier layers 15a and 15b, as a matter of course.

The step of injecting the molten base metal material 5 into the gap layers 4b to 4e of the ceramic sintered body 3 may be simplified by, e.g., placing the interior of the vessel 6 as shown in FIG. 3 under vacuum to remove the air from the gap layers 4b to 4e, prior to dipping the ceramic sintered body 3 in the base metal material 5. However, the effect of a vacuum on the ceramic sintered body 3 is similar to the effect of a reduction atmosphere, that is, the positive temperature coefficient of the ceramic material of the ceramic sintered body 3 is reduced.

Hence, such an evacuation step is not preferred.

EXAMPLE

Following is a description of an example prepared according to the present invention.

Ceramic material was prepared, comprising 97.1 mol % of barium titanate, with the addition of 0.8 mol % of yttrium oxide as a semiconductoring agent (dopant), 1 mol % of silicon dioxide and 1 mol % of aluminum oxide serving as mineralizers, and 0.1 mol % of manganese dioxide serving as a characteristic improving agent for increasing the positive temperature coefficient of resistance. These components were mixed with a binder to form a slurry, which are subjected to a doctor blade coater to form the ceramic green sheets 1a to 1f as shown in FIG. 1.

A ceramic powder was prepared by calcinating a powder material identical in composition to the above at 300° C. in air and re-pulverizing the same. 5 to 30% by weight of the ceramic powder was mixed with 70 to 95% by weight of carbon powder and further mixed with an organic vehicle to form a paste, which was printed on the ceramic green sheets to define the paste layers 2b to 2e as shown in FIG. 1.

The ceramic green sheets 1b to 1e, on which the paste layers 2b to 2e were printed, were sequentially laminated with the ceramic green sheets 1a and 1f having no paste layers, so as to alternately expose the edges of the paste layers 2b to 2e as shown in FIG. 1. The layers were bonded to each other under pressure, and the laminated body was fired at 1300° C. in air.

Upon each firing, carbon contained in the respective layers 2b to 2e was dissipated so as to define the porous gap layers 4b to 4e alternately open to the opposite end surfaces of the ceramic sintered body 3 as shown in FIG. 2.

Then the opposite end surfaces of the ceramic sintered body 3 were coated with a paste containing trinickel boride ($Ni_3B$) and lead borosilicate glass frit and baked in a natural atmosphere, to form porous barrier layers 15a and 15b of nickel, as shown in FIG. 6.

Then the ceramic sintered body 3 was dipped in a bath of molten lead-tin alloy material 5 as shown in FIG. 3. The liquid surface of the same material 5 was pressurized inject the lead-tin alloy 5 into the respective gap layers 4b to 4e. Thereafter the ceramic sintered body 3 was lifted from the bath of the lead-tin alloy 5 to be cooled. At this stage, the injected lead-tin alloy 5 remained in the gap layers 4b to 4e to define the inner electrodes 12b to 12e, as shown in FIG. 4. The nickel barrier layers 15a and 15b provided on the end surfaces of the ceramic sintered body 3 prevented leakage of the lead-tin alloy 5 from the gap layers 4b to 4e in the step of lifting the ceramic sintered body 3 from the bath. Further, the lead-tin alloy 5 also remained in the porous nickel barrier layers 15a and 15b, to form the pair of outer electrodes 13a and 13b, as shown in FIG. 5.

Figure 7:
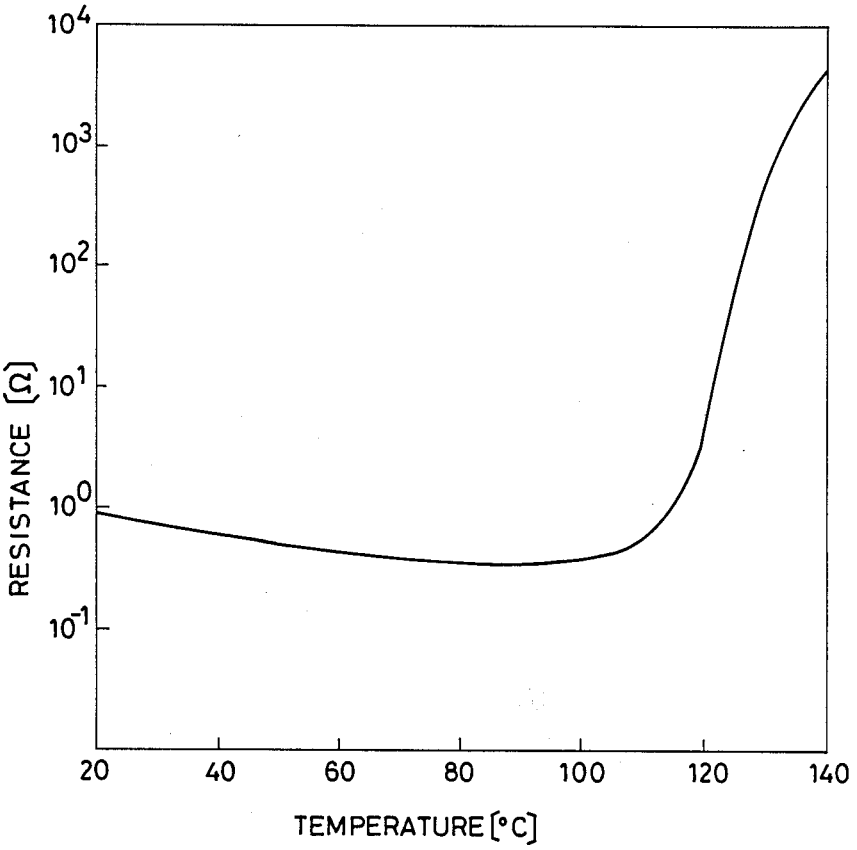
FIG. 7 is a graph showing the resistance-temperature characteristics of a laminated type PTC thermistor experimentally obtained according to the present invention.

A laminated PTC thermistor thus obtained was 10 mm in length, 5 mm in width and 2 mm in thickness. The resistance between the outer electrodes 13a and 13b was 0.1 to 0.3Ω, and the device presented a positive temperature coefficient of resistance as shown in FIG. 7.

Although embodiments of the present invention have been described and illustrated in detail, it is clearly understood that the same is by way of illustration and example only and is not to be taken by way of limitation, the spirit and scope of the present invention being limited only by the terms of the appended claims.

What is claimed is:

1. A thermistor having a positive temperature coefficient of resistance, said thermistor comprising:

a ceramic sintered body obtained by firing a plurality of laminated ceramic layers, said ceramic layers having a positive temperature coefficient of resistance;

a plurality of inner electrode layers arranged so that each of said ceramic layers is interposed between respective inner electrode layers; and a pair of outer electrodes formed in two different regions on the outer surface of said ceramic sintered body and connected to predetermined ones of said inner electrode layers, said inner electrode layers comprising metal and being in ohmic contact with said ceramic layers, and said inner electrode layers being formed of a metal selected from the group consisting of lead, tin, and lead-tin alloy injected in its molten state into a gap layer between each two of said ceramic layers under pressure from the outside and then hardened.

2. A thermistor in accordance with claim 1, said ceramic sintered body having a plurality of gap layers, each two of said ceramic layers having a gap layer therebetween, said gap layers comprising porous ceramic material, and said inner electrode layers being formed of metal injected into said gap layers.

3. A thermistor having a positive temperature coefficient of resistance, said thermistor comprising:

a ceramic sintered body obtained by firing a plurality of laminated ceramic layers, said ceramic layers having a positive temperature coefficient of resistance;

a plurality of inner electrode layers arranged so that each of said ceramic layers is interposed between respective inner electrode layers, said inner electrode layers being formed of a base metal having a low melting point selected from the group consisting of lead, tin, and lead-tin alloy injected in its molten state into a gap layer between each two of said ceramic layers under pressure from the outside and then hardened to form ohmic contact with said ceramic layers; and a pair of outer electrodes formed in two different regions on the outer surface of said ceramic sintered body and connected to predetermined ones of said inner electrode layers.

4. A thermistor in accordance with claim 3, said ceramic sintered body having a plurality of gap layers, each two of said ceramic layers having a top layer therebetween, said gap layers comprising porous ceramic material, and said inner electrode layers being formed of metal injected into said gap layers.

5. A thermistor having a positive temperature coefficient of resistance, said thermistor comprising:

a ceramic sintered body obtained by firing ceramic material having a positive temperature coefficient of resistance, said ceramic sintered body having a plurality of gap layers, each said gap layer opening onto a predetermined one of two different electrode regions on the outer surface of said body;

a plurality of inner electrode layers obtained by injecting base metal selected from the gap consisting of lead, tin, and lead-tin alloy having a low melting point in its molten state into said plurality of gap layers under pressure from the outside and hardening the same to form ohmic contact with said ceramic layers; and a pair of outer electrodes formed on the outer surface of said ceramic sintered body and connected to predetermined ones of said inner electrode layers.

6. A thermistor in accordance with claim 5, wherein said outer electrodes comprise conductive porous material.

7. A thermistor in accordance with claim 5, wherein said outer electrodes comprise porous barrier layers provided on the outer surface of said ceramic sintered body and base metal having a low melting point penetrating into said porous barrier layers.

8. A thermistor in accordance with claim 5, further comprising porous barrier layers provided between said outer electrodes and the outer surface of said ceramic sintered body, said base metal having a low melting point penetrating into said porous barrier layers.

9. A thermistor in accordance with claim 5, wherein said gap layers comprise porous ceramic material.

10. A method of manufacturing a ceramic electrical component comprising the steps of:

(a) providing a plurality of ceramic green sheets;

(b) applying a paste layer comprising a thermally removable material to selected surfaces of said ceramic green sheets, with one end of each paste layer extending to one end of the corresponding ceramic green sheet;

(c) arranging said ceramic green sheets into a laminated body with said paste layers alternating with said ceramic green sheets and each of said paste layers extending alternately to a respective one of two electrode faces of said body;

(d) sintering said laminated body so as to remove the thermally removable material in the paste layers and form gap layers;

(e) dipping the laminated body into molten metal selected from the group consisting of lead, tin and lead-tin alloy so that molten metal enters into said gap layers;

(f) solidifying said molten metal to form inner ohmic electrodes in said body, each of which extends to a respective one of said two electrode faces of said body;

(g) providing an outer electrode on each of said two electrode faces of said body, said electrode being connected to said inner electrodes which extend to the electrode face on which it is provided.

11. A method as in claim 10, wherein said method is for manufacturing a low-resistance PTC thermistor, and said ceramic green sheets include material exhibiting PTC characteristics after sintering.

12. A method as in claim 10, wherein said thermally removable material comprises carbon.

13. A method as in claim 12, wherein said paste layers further comprise ceramic powder consisting essentially of the same ceramic material as said ceramic green sheets.

14. A method as in claim 13, wherein said laminated body is sintered in air at about 1300° C. for about 1–2 hours.

15. A method as in claim 13, wherein said gap layers comprise porous ceramic material.

16. A method as in claim 10, further comprising a step of bonding said ceramic green sheets by compression to form said laminated body.

17. A method as in claim 10, wherein said molten metal comprises a base metal having a low melting point.

18. A method as in claim 10, wherein said molten metal is pressurized so as to inject said metal into said gap layers.

19. A method as in claim 10, further comprising forming porous barrier layers on said electrode faces of said laminated body prior to dipping said laminated body into said molten metal.

20. A method as in claim 19, wherein said porous barrier layers comprise sintered trinickel boride ($Ni_3B$) and lead borosilicate glass frit.

21. A method as in claim 19, wherein said porous barrier layers comprise sintered ceramic material.

22. A method as in claim 19, wherein said porous barrier layers retain metal after said solidifying step so as to constitute electrodes.

23. A thermistor having a positive temperature coefficient of resistance obtained by the method of claim 10.

24. A thermistor having a positive temperature coefficient of resistance obtained by the method of claim 11.

25. A thermistor having a positive temperature coefficient of resistance obtained by the method of claim 15.

26. A thermistor having a positive temperature coefficient of resistance obtained by the method of claim 19.

27. A thermistor having a positive temperature coefficient of resistance obtained by the following steps:

(a) providing a plurality of ceramic green sheets;

(b) applying a paste layer comprising a thermally removable material to selected surfaces of said ceramic green sheets, with one end of each paste layer extending to one end of the corresponding ceramic green sheet;

(c) arranging said ceramic green sheets into a laminated body with said paste layers alternating with said ceramic green sheets and each of said paste layers extending alternately to a respective one of two electrode faces of said body;

(d) sintering said laminated body so as to remove the thermally removable material in the paste layers and form gap layers;

(e) dipping the laminated body into a molten metal selected from the group consisting of lead, tin and lead-tin alloy so that molten metal enters into said gap layers;

(f) solidifying said molten metal to form inner ohmic electrodes in said body, each of which extends to a respective one of said two electrode faces of said body;

(g) providing an outer electrode on each of said two electrode faces of said body, said electrode being connected to said inner electrodes which extend to the electrode face on which it is provided.

* * * * *